United States Patent [19]

Wild et al.

[11] 3,950,876

[45] Apr. 20, 1976

[54] TRIGGER DEVICE FOR FIRE ARMS PARTICULARLY COMPETITION FIRE ARMS

[75] Inventors: Hermann Wild, Ulm; Ludwig Jaedicke, Thalfingen, both of Germany

[73] Assignee: J. G. Anschutz GmbH, Ulm, Germany

[22] Filed: Mar. 12, 1974

[21] Appl. No.: 448,787

[52] U.S. Cl. ..... 42/69 A; 42/69 R

[51] Int. Cl.[2] ..... F41C 19/00

[58] Field of Search ..... 42/69 A, 69 B, 69 R

[56] References Cited

UNITED STATES PATENTS

| | | | |
|---|---|---|---|
| 2,125,350 | 8/1938 | Loomis | 42/69 A |
| 2,126,076 | 8/1938 | Wright et al. | 42/69 A |
| 2,249,231 | 7/1941 | Smith | 42/69 A |
| 2,249,232 | 7/1941 | Smith | 42/69 A |
| 2,274,195 | 2/1942 | Garrison | 42/69 A |

*Primary Examiner*—Samuel Feinberg
*Assistant Examiner*—C. T. Jordan
*Attorney, Agent, or Firm*—Nolte and Nolte

[57] ABSTRACT

A trigger device for fire arms, particularly for competition fire arms, comprising an intercept latch having a contact surface pivotally connected in a trigger housing and releasably holding a firing element, a pivotally connected trigger latch having a contact surface and holding said intercept latch by its contact surface, a trigger lever, said trigger latch mechanically responsive to said trigger lever, a pivotally connected spring-biased lowering element in said trigger housing having a contact surface which engages the contact surface of said intercept latch and lowers said contact surface of said intercept latch onto the contact surface of said trigger latch so that said contact surface of said intercept latch rests on the contact surface of said trigger latch only just prior to complete actuation of said trigger latch which moves said trigger latch from out of engagement position with said intercept latch whereby said intercept latch is caused to drop out of holding position of said firing element whereby said firing element is released.

21 Claims, 9 Drawing Figures

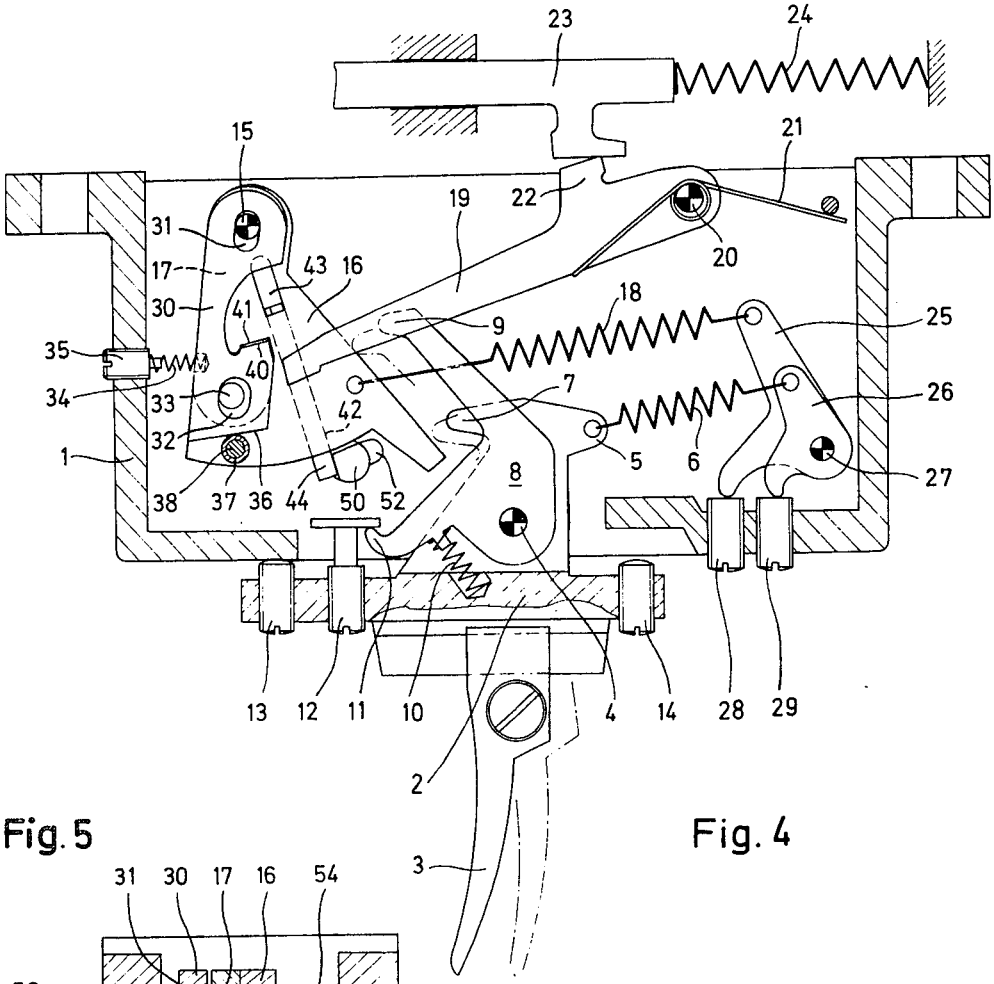
Fig. 4
Fig. 5
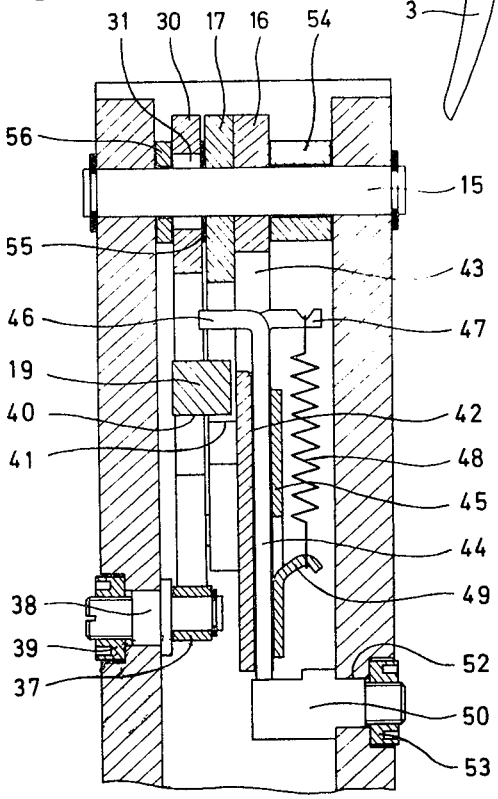
Fig. 6
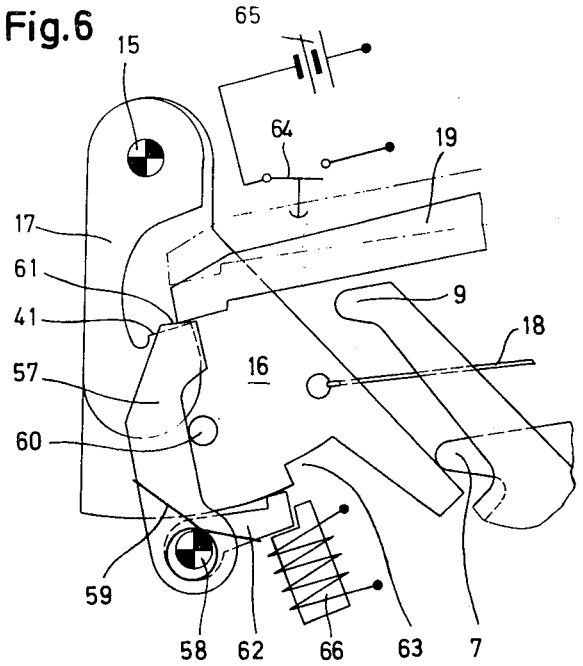

TRIGGER DEVICE FOR FIRE ARMS PARTICULARLY COMPETITION FIRE ARMS

BACKGROUND OF THE INVENTION

1. Field of the Invention

This invention relates to a trigger device for fire arms, particularly for competition fire arms, comprising an intercept latch which is pivoted in a trigger housing and can hold a spring-loaded element serving to release the firing such as, for instance, a firing pin, a hammer or an air pressure plunger, in its cocked position, as well as a trigger latch holding the intercept latch and a trigger lever which is in mechanical connection with the trigger latch directly or via intermediate members. More particularly, the present invention is directed to a trigger device for fire arms wherein means are provided to lower a pivotally connected intercept latch slowly upon a contact surface of a trigger latch so that no unnecessary wearing of the contact surface of the trigger latch or intercept latch is effected. The contact surface of the intercept latch is caused to be placed upon the contact surface of the trigger latch just prior to full actuation of the trigger mechanism which results in a release of the intercept latch from the trigger latch by pivotal movement of the trigger latch. Such releasing movement causes release of the firing element and discharge of the bullet.

2. Discussion of the Prior Art

Trigger devices must function with great precision particularly if they are incorporated in a sport weapon. A sporting rifleman wants to fire each shot as far as possible without delay at a time determined by him. The reason given for this is that even the best shot cannot hold the weapon aimed at the target completely steady and the shot must be released during the small, but unavoidable oscillatory movement completely prior to the movement the moment when the line of sight goes to the target. Many riflemen make a virtue out of this situation and address the target in a slow, swinging motion of the weapon in order to trigger at the suitable moment. The trigger process within the trigger device should therefore occur within at most one or two milliseconds. In addition, it is required that the release time and the release force should not change, as far as possible, even after extended use of the trigger device, but should remain constant.

The trigger devices known so far meet these requirements only imperfectly. Particularly delicate is in this problem area the interplay between the intercept latch and the trigger latch. As is well known, the intercept latch rests against the trigger latch with a trigger sear when the trigger device is ready to be tripped. With so-called pressure-point triggering and contact forces of several newtons, the overlap of the two latches is, for instance, about 0.2 mm. When the trigger lever is pulled through, this overlap is decreased up to the pressure point to about 0.02 mm. The intercept latch then drops off practically only due to an increase of the force at the trigger lever. With such a small final overlap, extreme accuracy and wear resistance of the break-away edges are important. However, the wear at these edges occurs less when the two latches slide off from each other than when the intercept latch is returned and placed back on, when hard shocks act on the delicate surfaces and break-away edges. If, deviating from the ideally desired geometric form, the break-away edges are rounded by even a slight amount or otherwise damaged, the intercept latch can slide off from the trigger latch already before or when reaching the pressure point. One usually attempts to compensate for the wear, once it has occurred, by advancing the pressure point. This, however, makes the internal release time longer than before, which has an unfavorable effect on the result of the firing.

Rounded break-away edges can also lead to the situation where, in playing the trigger at the pressure point, the two latches no longer slide back to greater overlap and are practically hung up against each other in an unstable position. By "playing" is meant here the repeated approaching and releasing of the pressure point prior to tripping. Playing is used by many riflemen, because they want to trigger the shot only under optimum conditions. However, if the latches hang together at the pressure point position during this playing, which is not immediately recognizable to the rifleman, controlled triggering is no longer possible and the shot can go off at the slightest vibration of the weapon.

It has therefore become desirable to provide a trigger device in which the delicate surfaces and break-away edges of the mechanical parts of the trigger device are not caused to undergo unnecessary wear. It has also become desirable to provide a trigger device having a small final overlap of the contact surfaces whereby the contact surface of the intercept latch rests upon the contact surface of the trigger latch only just prior to full actuation of the trigger mechanism. It therefore has become desirable to provide a means for lowering the intercept latch slowly upon the contact surface of the trigger latch whereby unnecessary wear of the contact surfaces of the trigger latch and intercept latch are avoided.

It is an object of this invention to provide a trigger device for fire arms, in which the natural wear of the overlap surfaces and the break-away edges of the intercept and trigger latch is appreciably reduced. It is a further object of the present invention to provide a trigger device for fire arms in which means are provided to slowly lower the intercept latch so that it rests upon the trigger latch only just prior to full actuation of the firing mechanism.

SUMMARY OF THE INVENTION

In one of its broad aspects, the present invention contemplates a trigger device for fire arms, particularly for competition fire arms, comprising an intercept latch having a contact surface pivotally connected in a trigger housing and releaseably holding a firing element, a pivotally connected trigger latch having a contact surface and holding said intercept latch by its contact surface, a trigger lever, said trigger latch mechanically responsive to said trigger lever, a pivotally connected spring biased lowering device in said housing having a contact surface which engages the contact surface of the intercept latch and lowers said contact surface of said intercept latch onto the contact surface of said trigger latch so that said contact surface of said intercept latch rests on the contact surface of said trigger latch only just prior to complete actuation of said trigger lever which moves said trigger latch from out of engagement position with said intercept latch whereby said intercept latch is caused to drop out of holding position of said firing element whereby said firing element is released.

A part of the present invention there is a pivotally connected lowering device in the form of a lowering latch which is spring biased with a weak spring. This lowering latch is adaptable to engage with the contact surface of the intercept latch prior to the time that such surface of the intercept latch would engage the surface of the trigger latch. The lowering device gently lowers the intercept latch during the firing operation so that it rests upon the delicate surface of the trigger latch just prior to final complete actuation of the trigger mechanism of the trigger device. This has the decided beneficial effect that unnecessary wearing of the delicate surface of the contact surface of the intercept latch and the contact surface of the trigger latch is avoided. Moreover, undue friction caused by the firing or by the movement of the fire arm is avoided because the contact surface of the intercept latch and the contact surface of the trigger latch are only in position and ready for disengagement just prior to the final movement of the trigger lever.

According to the invention, therefore, the problems attendant prior art firing devices are solved by providing an intercept and lowering device which is built in a trigger housing which lowering device retards and slowly lowers the intercept latch shortly before it is placed on the trigger latch. The present invention further provides an automatically engaging and disengaging return lock for the trigger latch or the trigger lever. As an alternate, a support for the intercept latch is provided which is movable lengthwise against spring pressure.

In the trigger device of the present invention the intercept and lowering latches do not engage one another at the delicate functional surfaces and edges, but at another point, for instance, laterally displaced therefrom. This, however, is not an aggravating requirement, as it is met quite readily. Moreover, the remote surfaces which are involved in the engagement of the lowering latch with the intercept latch do not play a part in the final actuation of the firing mechanism when the contact surface of the trigger latch is removed from the contact surface of the intercept latch. However, in a broad aspect of the present invention the contact surface of the lowering latch can engage the same portion of the contact surface of the intercept latch which is engaged by the contact surface of the trigger latch.

In a simple embodiment of the present invention the intercept and lowering devices can take the form simply of a pin which is inserted crosswise through the trigger housing, with an inclined lowering surface for the intercept latch. This is so if one were willing to accept the fact that the pin must be pushed back and forth by hand before each firing. Under similar conditions, a lowering eccentric can also be employed. Manual operation, however, is generally too cumbersome so that it is far more desirable to provide an intercept and lowering device according to the invention which operates automatically. It is moreover advantageous that the intercept and lowering devices be independent of the moving parts of the lock, so that the trigger device can be used in different weapons without difficulty.

Accordingly, the intercept and lowering device consists advantageously of a lowering latch which is pivoted about a post jointly with the trigger latch but is fastened to it in a torsion-proof manner and is movable transversely to the direction of rotation, as well as of a control roller which is attached at the trigger housing and supports the narrow end, further removed from the pivot, of the lowering latch, which is designed as a control cam set at an angle to the tangent to the path of motion. The lowering latch can therefore be swung synchronously with the trigger latch and additionally is movable transversely to the direction of rotation. For this purpose, suitable linear guides are provided between the trigger and the lowering latch.

The displacement comes about only simultaneously with a swing motion and its magnitude depends on the slope of the cam, which rests against the control roller that is in fixed relationship to the housing. This slope is preferably chosen so that the output force at the control roller is at equilibrium with the frictional force of the roller. In this manner the lowering latch has no effect of any kind on the magnitude of the trigger force. This is important just at the moment when the lowering latch has been lowered to the point that the intercept latch settles on the trigger latch.

For putting on the intercept latch, the lowering has a contact surface the same as the trigger latch, but with the difference that the jump edge of the lowering latch is set back very slightly relative to the break-away edge of the trigger latch. This ensures that the intercept latch no longer touches the lowering latch after sliding off the trigger latch.

It can happen, particularly in trigger devices with a light touch, that the return spring of the trigger latch is not strong enough to pull the latter back against the resistance of the lowering latch if the trigger latch had been pulled up to the pressure point but was then released again without the intercept latch being released. The intercept latch is then supported only very narrowly, which is dangerous. To avoid this, it is provided according to another embodiment, that the lowering latch is not torsion-proof but can rotate about its pivot and can be taken along by the deflectable trigger latch by a coupling pin only in the release direction, while no taking-along takes place in the return direction, and that a relatively weak spring, acting in the return direction, is arranged at the lowering latch. This spring has a negligible effect on the magnitude of the trigger force, i.e., it is very much weaker than the return spring of the trigger latch. Its purpose is to swing the lowering latch back into the intercept position after the intercept latch is released.

In a further embodiment the intercept and lowering device is a lowering latch pivoted on a post located to the side of the trigger latch and a coupling pin which transmits to the lowering latch only the motion of the trigger latch in the direction of the release motion, and the lowering latch is loaded in the return direction by a relatively weak torsion spring. The contact surface of the lowering latch is set at a slight angle to the tangent to the path of motion. When the lowering latch is swung in the trigger direction, this inclination causes the intercept latch to be lowered onto the trigger latch. This inclination should preferably be only so steep that the friction force due to the contacting intercept latch after subtracting the driving force is still so large that no jump in the force occurs at it when the trigger lever is pulled through, if the intercept latch settles on the trigger latch and the friction force is then taken up by the latter.

Due to the physical separation of the two pivots for the trigger and the lowering latch and by locating the coupling pin in the proximity of the fulcrum of the lowering latch, a transmission ratio is created between the two latches, by which the lowering latch swings faster than the trigger latch. Thereby, it also gets out of the region of the intercept latch faster.

In another embodiment, the intercept and lowering device consists of a leg linked at the sear end of the intercept latch and fastened at a trigger latch blade by an oscillation guide as well as of a support cam with an inclined slide-off surface fixed in the housing, against which the leg rests if the trigger device is ready for triggering. The support is attached adjustably transversely to the leg at the trigger housing. The angle of the slide-off surface at the support cam is preferably determined by the same considerations which are described above for the inclination of the lowering latch.

A further possibility to modification resides in supporting the lowering latch, next to the trigger latch and on the pivot of the latter, so that it is freely rotatable and to provide at the trigger lever, in addition to the pull-up and pressure point cams cooperating with the trigger latch, a lowering latch, a lowering cam which is in contact only with the lowering latch. Upon operating the trigger lever, the two latches are swung in the same direction via the various cams, the lowering latch moving faster than the trigger latch because of the larger chosen lever ratio. As the lowering latch edge, on which the intercept latch rests initially, describes a low circular arc in this process, the intercept latch is lowered on the trigger latch gradually, from the breakaway edge of which it drops off slightly later.

In addition to the intercept and lowering device described, there is further provided an automatic return lock for the trigger latch. The return lock may consist, for instance, of a spring-loaded locking bar which is movably guided, in the direction of motion of the intercept latch, at a trigger latch blade firmly connected with the trigger latch and whose one end rests against a stop fixed at the housing, from where it drops immediately after the release of the intercept latch at a sharply defined edge, if the trigger latch blade is swung accordingly. The second end of the bar has an angled-off coupler, which projects into the motion space of the intercept latch between the upper end position and the intercept position of the latter.

The locking bar, which has fallen off its stop after the shot has been fired, prevents the trigger latch from being retracted by the return spring. The lowering latch is also indirectly held back thereby. Consequently, the intercept latch can return to its intercept position unimpeded when the lock is cocked again. After having passed both latch edges with little clearance in this process, it hits, however, the dog of the locking bar and retracts it from its locking position, whereupon the trigger and the lowering latch return to their starting position and again support the intercept latch.

The return lock can also consist of a locking element which is arranged movably or pivoted at the trigger housing and drops into a detent notch of the trigger latch due to spring force at the proper time and is pushed out of it by means of a suitable coupling by the returning intercept latch. The coupling can be mechanical, but also electrical. For the electrical type of design, an electric micro switch, which is briefly closed by the intercept latch in its upper end position, would have to be attached in the trigger housing in the vicinity of the upper end position of the intercept latch. During the closing phase, an electric current can flow from a current source to an electromagnet which pulls the locking element out of the detent notch, so that the trigger latch returns to its starting position.

Additionally, the locking element can operate with a detent notch at the trigger lever, as the trigger lever is in mechanical driving connection with the trigger latch.

Moreover, the intercept latch can be moved past the latches into the intercept position without contact by removing the intercept latch temporarily from the vicinity of the latches after its release by the trigger latch and before it is set up again. This can be accomplished by longitudinally movable pivoting of the intercept latch as well as by a spring which strives to pull the intercept latch away from the trigger latch. This spring must be weaker than the spring for the fire-releasing element, which is held temporarily by the intercept latch and displaces the latter in the process up to the stop in the latch direction.

The longitudinally movable pivoting of the intercept latch can consist of a sliding block which is movably supported between the side walls of the trigger housing and at which the intercept is pivoted. However, it is simpler to make the bearing hole of the intercept latch elongated and to attach the pivot at the trigger housing.

It should further be noted that the different designs of the intercept and lowering device on the one hand, and the return lock or of the intercept latch displacement, on the other hand, can be combined with one another freely. One therefore has a fairly large number of possible combinations.

The advantages achieved with the invention are in particular that the delicate contact surfaces and breakaway edges of the intercept and trigger latches are completely freed of shock and in part of frictional motion, which reduces wear and multiplies the service life. On the other hand, the reduced wear has a beneficial effect on the constancy of the internal trigger time. The trigger device can also be adjusted very "dry", which means that the overlap of the latches beyond the pressure point can be extremely narrow without affecting the reliability of operation. This possibility is generally desired by riflemen.

BRIEF DESCRIPTION OF DRAWINGS

Various embodiment examples of the invention are illustrated in the drawings and will be described in detail in the following. In the appended drawings:

FIG. 4 is a longitudinal cross section through a trigger device corresponding to FIG. 1 after a shot has been fired;

FIG. 5 is a cross section shown on an enlarged scale along the line V—V in FIG. 1;

FIG. 6 is a detail of the trigger device, ready to be triggered, of a second embodiment;

DESCRIPTION OF SPECIFIC EMBODIMENTS

Figure 1:
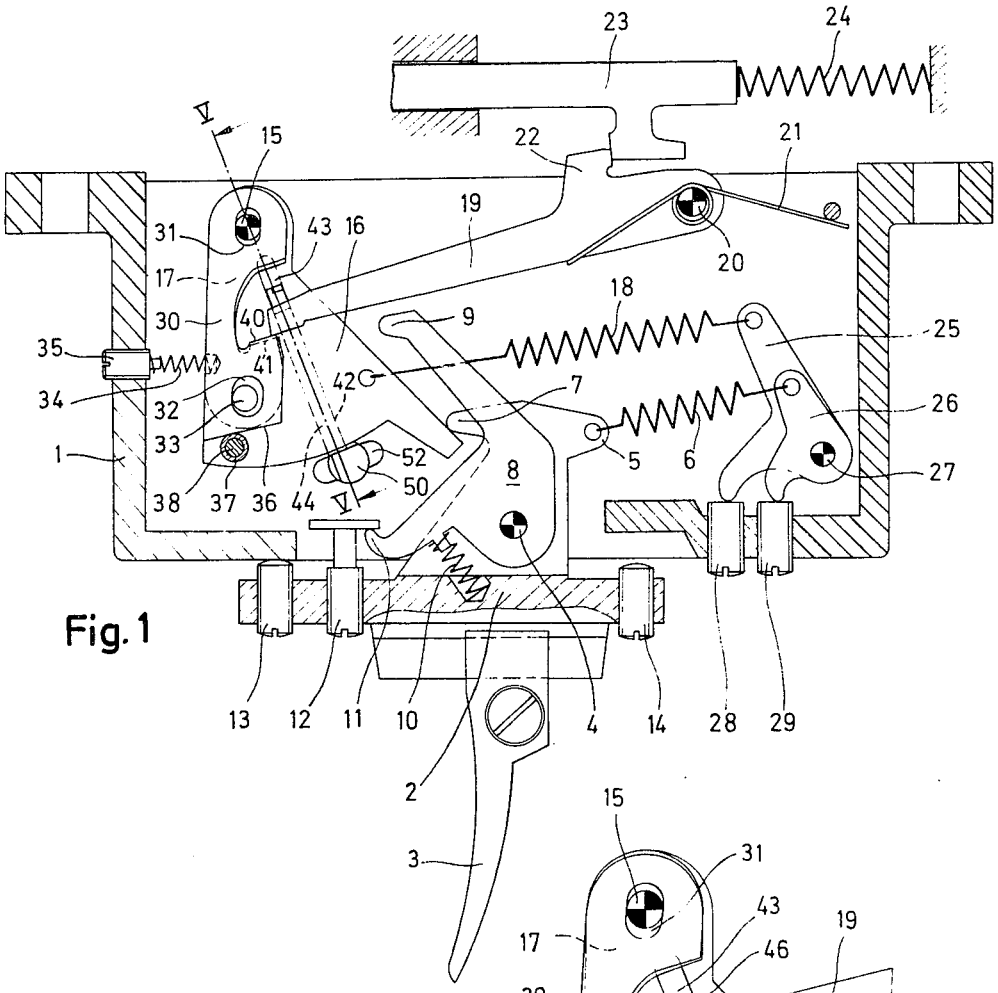
FIG. 1 is a longitudinal cross section through a trigger device according to the invention, in ready-to-trigger condition.

The trigger device has the same basic equipment, which is the same in all embodiments: In a trigger housing 1 a trigger lever 2 with a finger trigger horn 3 clamped thereon is fulcrumed on a post 4. The part of the trigger lever 2 located inside the trigger housing 1 has an eye 5, into which a tension spring 6 is hung, and a pull-up cam 7. Regarding the details of the design and arrangement of this and all parts, reference is expressly made to the figures. Laterally immediately adjacent the trigger lever 2 is pivoted on the pin 4 a pressure point cam lever 8, which has a pressure point cam 9. It is loaded by a compression spring 10 which is braced against the trigger lever 2, so that it rests against a mushroom-shaped adjusting screw 12 with a lug cam 11. With this adjusting screw 12 which is screwed into the trigger lever 2 with a tight fit, the pressure point cam lever 8 can be swung within certain limits and the pressure point of the trigger device can be accurately adjusted to the desired value. Into the trigger lever 2 are further screwed two stop screws 13 and 14, which limit the movement of the trigger lever in both directions through contact with the trigger housing 1.

On a pivot pin 15 transversely fastened in the trigger housing 1 are pivoted an essentially circular section-shaped trigger latch blade 16 and a trigger latch 17. The trigger latch blade 16 and the trigger latch 17 are flat, laterally adjacent parts (FIG. 5), which are rigidly connected with each other by means not shown here. At the trigger latch blade 16 a return spring 18 engages, which strives to rotate it against the release direction and holds it in contact with the pull-up cam 7 of the trigger lever 2.

In the trigger housing 1 is furthermore fulcrumed on a fulcrum pin 20 an intercept latch 19. It is loaded clockwise (against the release direction) by a torsion spring 21, so that it projects with an intercept cam 22 into the path of motion of a firing pin 23, which is movably guided in the lock of the weapon, or a corresponding air compression plunger in the case of an air rifle, and can hold it in its cocked position. One end of a firing pin spring 24 bears against the firing pin 23 and tries to move it in the firing direction. In the ready-to-release intercept position according to FIG. 1, the intercept latch 19 is pushed down onto the trigger latch 17 by the firing pin 23 against the action of the torsion spring 21 in the direction toward the trigger latch 17.

The return spring 18 is hung with its other end in a setting cam 25, and likewise, the tension spring 6 at a setting cam 26. Both setting cams 25 and 26 are rotatably supported side by side on a pin 27 and can each be swung by a set screw 28 or 29, respectively. In this manner, the trigger force can be varied.

All this is part of the basic equipment of the trigger device, which remains the same in all embodiments.

FIGS. 1 to 5 show one embodiment, in which the lowering latch 30 is mounted on the fulcrum pin 15 in addition to the trigger latch blade 16 and the trigger latch 17 fastened thereto. It is largely identical with the trigger latch 17, which in FIGS. 1 to 4 is covered up by it and is therefore hard to see. As the bearing bore of the lowering latch 30 is an elongated hole 31, the lowering latch 30 can be displaced transversely to the fulcrum pin 15. The narrow end of the lowering latch 30, further away from the fulcrum pin 15, also has an elongated hole 32, whose side is as long or longer than that of the elongated hole 31. The longitudinal axes of the two elongated holes 31 and 32 have the same direction and extend in the longitudinal direction of the lowering latch 30. The elongated hole 32 surrounds a coupling pin 33, whose diameter is considerably smaller and which is rigidly fastened to the trigger latch 17. It serves to take the lowering latch 30 along in the release direction when the trigger latch 17 is swung out. Due to the difference in diameter, no taking-along takes place in the opposite direction. The lowering latch 30 is rather moved in this direction by a compression spring 34 acting on its back, which, however, is to be possible only in the free-wheeling condition. For this reason the compression spring 34 must act on the lowering latch 30 only with light force, the magnitude of which can be set by means of a regulating screw 35.

The end of the lowering latch 30 facing away from the fulcrum pin 15 has a control cam 36 and therewith rests on a control roller 37, which is rotatably supported in an eccentric cam 38 fastened at the trigger housing 1 (FIG. 5). The eccentric cam 38 is clamped in the wall of the housing by means of a nut 39. However, it can be rotated after the nut is loosened in order to adjust the lowering latch 30 with respect to the trigger latch 17. The control cam 36 is designed as a straight, flat surface which is set at an angle to the tangent to its path of motion. However, it can also follow the shape of an Archimedes' spiral in its lengthwise direction, its center being at the center of the fulcrum pin 15. The advantage of the Archimedes spiral is that the angle of attack of the control curve 36 relative to the control roller 37 does not change while the lowering latch 30 is rotated. The direction of the inclination of the control curve 36 is such that the lowering latch 30 is lowered when swung in the release direction, or raised in the return direction.

The lowering latch 30 has a contact surface 40, and the trigger latch 17 a surface 41 for the intercept latch 19. The jump edge at the right-hand end of the contact surface in FIG. 1 is set back somewhat against the break-away edge of the contact surface 41, so that the intercept latch 19 can drop off from the trigger latch 17 upon release, without being impeded by the lowering latch 30.

In the ready-to-trigger condition of the trigger device according to FIG. 1, the contact surface 40 of the lowering latch 30 is somewhat above the contact surface 41 of the trigger latch 17. Consequently, the intercept latch 19, which is loaded by the firing pin 23 after the lock of the weapon is cocked, sits first only on the contact surface 40 and gives off its impact energy there.

If then the trigger lever 2 is pulled to fire a shot, the lowering latch 30 as well as the trigger latch 17 are rotated equally clockwise (FIG. 1), whereby in addition the lowering latch 30 is lowered, so that the intercept latch 19 is carefully placed on the contact surface 41 of the trigger latch 17. When the pressure point is reached (FIG. 2), i.e., when the pressure-point cam 9 touches the trigger latch blade 16, the contact surface 40 has already dropped somewhat below the contact surface 41. If, however, the trigger lever 3 is not now pulled through any further, but let go ("playing" the trigger lever), the trigger latch 17 slides back further again under the intercept latch 19 due to the force of the return spring 18. The lowering latch 30, however, follows only to the point where its contact surface 40 hits the intercept latch 19, as the compression spring 34 is too weak to lift the intercept latch 19 (FIG. 3).

Figure 2:
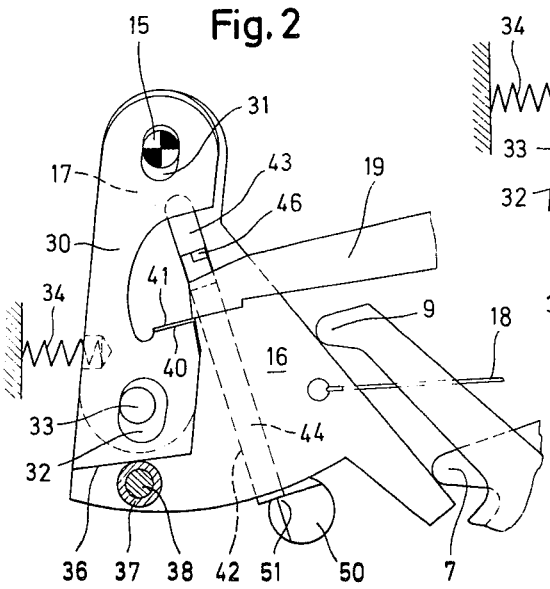
FIG. 2 is an enlarged presentation of a detail of FIG. 1 with the trigger at the pressure point.
Figure 3:
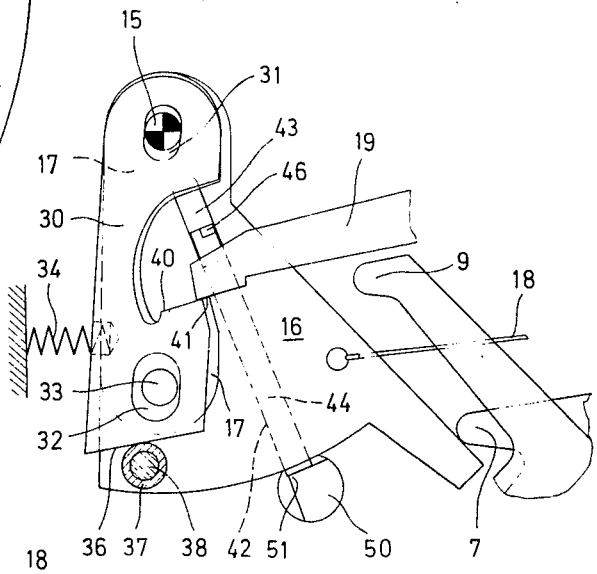
FIG. 3 is an enlarged presentation of a detail of FIG. 1 with the trigger released again after being partly pulled through without release.

As may be seen from FIGS. 1 to 4, and in particular from FIG. 5, a rectangular slot 42 is machined into the trigger latch blade 16; in the vicinity of the fulcrum pin 15 it goes over into a transversal cutout 43 and extends essentially at right angles to the direction of motion of the trigger latch blade 16. Into the rectangular slot 42 is movably inserted a locking bar 44 of also rectangular cross section and is enclosed by a cover plate 45, which is firmly connected with the trigger latch blade 16. The locking bar 44 has at the end facing the fulcrum pin 15 a dog 46 which is bent out at right angles and passes through the transversal cutout 43, and an arm 47 bent in the opposite direction, at which a tensioned spring 48 is hung, which has its opposite support at a bent-out hook 49 of the cover plate 45. The locking bar 44 is braced at its other end against a stop 50, which has a sharply defined edge 51 (FIGS. 2 and 3). The stop 59 is movably guided in an elongated hole 52 of the right-hand side wall of the trigger housing 1 for purposes of adjustment and can be clamped anywhere by a nut 53.

The locking bar 44 serves as the return lock for the trigger latch 17 and operates as follows: At the moment when the intercept latch 19 drops off from the trigger latch 17, if the trigger lever 2 is pulled through, the locking bar 44 is still supported by the stop 50 over a width of, say, a few tenths of a millimeter. Through the recoil of the gun and possibly by further pulling through of the trigger lever 2, the trigger latch blade 16 with the trigger latch 17 continues to rotate in the release direction, so that immediately thereafter the locking bar 44 drops off over the boundary edge 51 of the stop 50. If then, after releasing the finger trigger horn 3 the trigger latch blade 16 is pulled back by the return spring 18, the locking bar 44 places itself crosswise in front of the stop 50 and prevents the trigger latch blade from swinging back further (FIG. 4).

If the firing pin 23 is cocked again, the intercept latch 19 erects itself again and passes without touching, with a small clearance, the break-away edge of the trigger latch 17. In this process it hits the dog 46 and pulls the locking bar 44 out of its locking position, whereupon the trigger latch blade 16, the trigger latch 17 and the lowering latch 30 return immediately into the starting position and again support the intercept latch 19. Compared with this, it takes longer until the firing pin 23 has been moved by the manually operated weapon lock from its farthest retracted position to the intercept cam 22 and pushes the intercept latch 19 down on the lowering latch 30. Thus, the intercept latch 19 is shored up with a margin of safety in the manner provided, before setting up again. Also, the locking bar 44 is then again above the stop 50 and is pulled down on it by the tension spring 48.

For the sake of completeness, it should further be noted that spacer washers 54, 55 and 56 are placed on the fulcrum pin 15 (FIG. 5), which insure the necessary spacings of the latches between each other and from the side walls of the trigger housing 1.

FIG. 6 shows a section of a second embodiment of the trigger device. Here is provided, in addition to the already described parts, a lowering latch 57, which is pivoted not on the fulcrum pin 15, but on a pin 58 attached in the trigger housing 1 outside of the trigger latch blade 16. It is pressed against a round coupling pin 60 attached at the trigger latch blade 16 by a torsion spring 59 with light force. The lowering latch 57 has a lowering surface 61, which is set at a slight angle to the tangent of the path of motion and which in the intercept position of the lowering latch 57 is somewhat above the contact surface 41 of the trigger latch 17 with the area, on which the intercept latch 19 sets. Its lowest point, however, is slightly below the contact surface 41. Consequently, the intercept latch 19 is lowered slowly in the release direction onto the contact surface 41 of the trigger latch 17 during the deflection of the lowering latch 57. If the trigger motion is interrupted or cancelled for any reason during or after this, the lowering latch 57 does not slide again under the intercept latch 19, because the torsion springs 59 are not strong enough therefor.

A pawl 62, loaded by the torsion spring 59 and supported on the pin 58, serves as the return lock. It drops into a detent notch 63 of the trigger latch blade 16, as soon as the intercept latch 19 has dropped off from the trigger latch 17 and the recoil of the triggered shot has turned the trigger latch 17 a little further in the trigger direction. Swinging back is then at first impossible. This is possible again only when, after the firing pin 23 is cocked again, the intercept latch 19 is raised again, passes the latches with little clearance without touching and has closed an electric microswitch 64 shortly before reaching its upper end position. Thereby, an electric circuit from a current source 65 to an electromagnet 66 is closed. Upon being energized, the electromagnet 66 pulls the pawl 62 out of the detent notch 63 instantly, whereupon the trigger latch blade 16, the trigger latch 17 and the lowering latch 57 return to their starting position and the intercept latch 19 is again shored up. As soon as the intercept latch 19 descends again in its upper end position onto the lowering latch 57, the microswitch 64 opens and the pawl 62 drops off from the electromagnet 66 into its ready position shown in FIG. 6.

Figure 7:
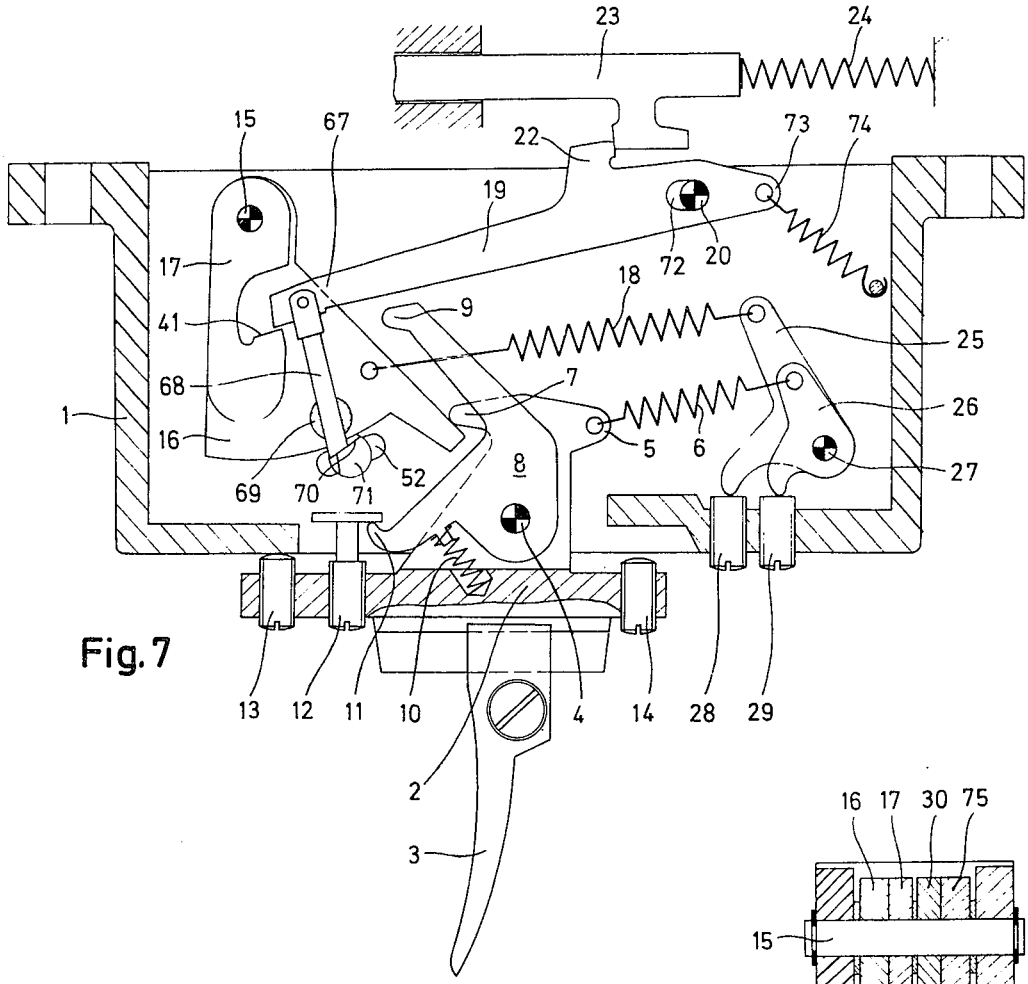
FIG. 7 is a longitudinal cross section through the trigger device, ready to be triggered, of a third embodiment.

FIG. 7 shows a third embodiment of the trigger device. Here a leg 68 is linked at the catch end 67 of the intercept latch 19. It is guided in an oscillating slide 69 which is rotatably fastened in the trigger latch blade 16 and bears with its free end against a slide-off surface 70, of a support cam 71, which is set at an angle to its longitudinal axis. The support cam 71 is identical, with the exception of the inclined slide-off surface 70, with the stop 50 from FIGS. 1 to 5 and, like the latter, is adjustably attached in an elongated hole 52 at the right-hand side wall of the trigger housing 1.

It is the purpose of the leg 68 and the support cam 71 to intercept the intercept latch 19, which holds the firing pin 23, shortly before it strikes the trigger latch 17 and to lower it onto the contact surface 41 only after the release of the movement. Not later than after reaching the pressure point, however, the leg 68 must be swung to the side by the trigger latch blade 16 so far that it can pass downward, past the support cam 71, when the intercept latch 19 drops off.

Deviating from the design arrangements described so far, the bearing bore of the intercept latch 19 is made as an elongated hole 72. The intercept latch 19 has further also an eye 73, at which a tension spring 74 engages, which is fastened in the trigger housing 1 and is under tension. The tension spring 74 tries to swing the intercept latch 19 against its direction of release and to pull it away from the trigger latch 17, which, however, is not possible if the firing pin 23 is captive, as the latter's opposing force effect is by far greater. Only when the firing pin 23 is released, the intercept latch 19 is retracted by the tension spring 74. If it is raised up again later when the firing pin is cocked again, it is ensured thereby that it does not touch the trigger latch 17. After cocking, the firing pin 23 rests against the intercept cam 22 and moves the intercept latch 19 again toward the trigger latch 17, before it presses the latter down on the support cam 71 until the leg 68 is set up.

Figure 8:
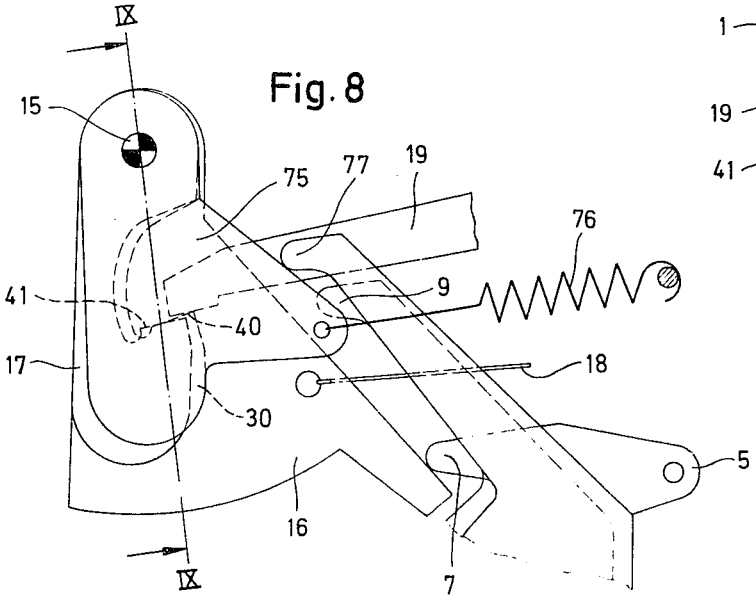
FIG. 8 is a detail of the trigger device, ready to be triggered, of a fourth embodiment.
Figure 9:
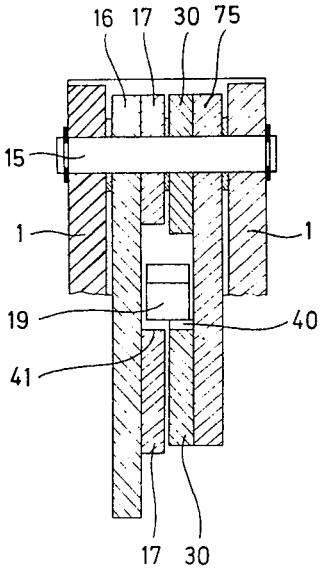
FIG. 9 is a cross section along the line IX—IX of FIG. 8.

FIGS. 8 and 9 show a fourth variant of the trigger device. Particularly, FIG. 9 shows clearly that on the fulcrum pin 15 are rotatably supported, in addition to the trigger latch 17, the lowering latch 30 and a lowering latch blade 75 firmly connected thereto. At the lowering latch blade 75, a tension spring 76 attacks, which is just so strong as to swing the lowering latch blade 75 against the release direction in the free-wheeling direction. If the intercept latch 19 sits, similarly as shown, on the contact surface 40 of the lowering pad 30, the tension spring 76 is no longer capable to overcome the additional friction force.

The trigger lever 2 is equipped, in addition to the pull-up cam 7 and the pressure point cams 9, also with a lowering cam 77, against which the lowering latch blade 75 rests in the position shown. It is considerably closer to the fulcrum pin 15 than the pull-up cam 7, so that when the trigger lever 2 is pulled through in the release direction, the lowering latch blade 75 and the lowering latch 30 are rotated by a larger angle than the trigger latch blade 16 and the trigger latch 17, due to the difference in the transmission ratio. The lowering latch 30 therefore deposits the intercept latch 19 on the contact surface 41 of the trigger latch 17 and leaves the motion space of the intercept latch 19 still before the pressure point cam 9 hits the trigger latch blade 16.

From the above it is seen that several different embodiments have been shown for a trigger device in which a lowering element is employed to lower the contact surface of the intercept latch upon the contact surface of the trigger latch slowly so as to avoid unnecessary wear of these contact surfaces and break-away surfaces. The present invention insures that when the desired discharge of the firing element is to be accomplished that the mechanical components of the trigger device will function to provide such desired discharge. Moreover, accidental discharging of the delicate firing mechanism is precluded. It will be realized that at the heart of the present invention is the use of the lowering device and that other constructions utilizing a lowering device are contemplated. Moreover, it will be realized that the lowering device which works in conjunction with the trigger latch and intercept latch can be utilized in other firing mechanisms where in the trigger lever and trigger mechanisms themselves are different than that specifically shown.

What is claimed is:

1. A trigger device for fire arms, particularly for competition fire arms, comprising an intercept latch having a contact surface pivotally connected in a trigger housing and releasably holding a firing element, a pivotally connected trigger latch having a contact surface and holding said intercept latch by its contact surface, a trigger lever, said trigger latch mechanically responsive to said trigger lever, a lowering device in said housing having a contact surface which engages the contact surface of said intercept latch and lowers said contact surface of said intercept latch onto the contact surface of said trigger latch so that said contact surface of said intercept latch rests on the contact surface of said trigger latch only just prior to complete actuation of said trigger lever which moves said trigger latch from out of engagement position with said intercept latch whereby said intercept latch is caused to drop out of holding position of said firing element whereby said firing element is released.

2. A trigger device according to claim 1, further comprising an automatically engaging and disengaging return lock device for the trigger latch.

3. A trigger device according to claim 1, wherein said lowering device comprises a lowering latch swinging about a fulcrum pin, said trigger latch swinging about the same fulcrum pin, said lowering latch movable transversely to the direction of rotation, a controller roller over which said lowering latch rolls attached at said trigger housing, said lowering latch having an end remote from said fulcrum pin which is a control cam which bears against said controller roller and is set at an angle tangent of the path of motion.

4. A trigger device according to claim 3, wherein said control cam has an angle of inclination to the tangent of the path of motion, at which the outward force at said controller roller is at equilibrium with the friction force of said roller.

5. A trigger device according to claim 3, wherein said controller roller is supported on an eccentric cam which is rotatable and lockable.

6. A trigger device according to claim 3, wherein said lowering latch is movably connected to said trigger latch by a coupling pin only in the direction of release so that no taking along takes place in the return direction, at said lowering latch there is a spring effective in the return direction.

7. A trigger device according to claim 3, wherein said control cam is a section of an Archimedes spiral, whose center is at the center of the fulcrum pin.

8. A trigger device according to claim 1, wherein said device comprises a lowering latch rotatably supported on a pin located outside of said trigger latch and to the side of a coupling pin, which coupling pin engages said lowering latch only upon movement of said trigger latch in the release direction, said lowering latch loaded in the return direction by a torsion spring.

9. A trigger device according to claim 8, wherein the contact surface of said lowering latch is set at a slight angle to the tangent of the path of motion.

10. A trigger device according to claim 8, wherein the contact surface of said lowering latch has an inclination at which the frictional forces of the contacting parts, after subtracting the driving forces, are so large that no changes in the force occur at said trigger lever if the trigger lever is pulled through, when said intercept latch is set on said trigger latch.

11. A trigger device according to claim 1, wherein a leg is linked at a catch end of said intercept latch and is attached to a trigger latch blade integrally connected with said trigger latch by an oscillation guide and a support cam in fixed relationship to said trigger housing, said support cam having an inclined sliding-off surface against which said leg is braced when the trigger device is ready to be triggered.

12. A trigger device according to claim 11 wherein at the inclined sliding-off surface of said support cam, the frictional forces of the contacting parts after subtracting the driving forces, are so large that no changes in the force occur at said trigger lever if the trigger lever is pulled through, when said intercept latch is set on said trigger latch.

13. A trigger device according to claim 1, wherein said lowering device comprises a spring-loaded lowering latch which is rotatably supported on a fulcrum pin on which said trigger latch is rotatable and said device further comprises a lowering cam firmly connected to said trigger lever and touching said lowering latch.

14. A trigger device according to claim 1, wherein said trigger latch is spring-biased in said trigger housing and said device further comprises limiting means for limiting movement of said trigger latch in the direction of tension from said spring.

15. A trigger device according to claim 14, wherein said limiting means comprises a slot in a trigger latch blade which trigger latch blade is integrally connected to said trigger latch, a cut-out which extends at right angle transversely to the direction of motion of the trigger latch blade, said slot containing a spring-biased locking bar of the same cross section having at the end facing the pivot point of said trigger latch a dog bent at right angles and passing through said transverse cut-out, said locking bar braced at its other end against a stop which limits the movement of said trigger latch blade and trigger latch when said locking bar bears thereagainst.

16. A trigger device according to claim 15, wherein said stop can be adjusted approximately at right angles to the said locking bar.

17. A trigger device according to claim 1, wherein a spring-loaded, electromechanical disengageable pawl is pivoted on a pin fixed to said housing and a detent notch is provided on a trigger latch blade which is firmly connected to said trigger latch and into which said pawl drops immediately after release of said intercept latch when said blade is rotated, said trigger device further comprising an electric microswitch closed by said intercept latch as it rises again, shortly before its upper end position and closes a circuit with an electromagnet of said pawl.

18. A trigger device according to claim 1, wherein said intercept latch is rotatably supported at a sliding block which is guided longitudinally movably between the side walls of said trigger housing.

19. A trigger device according to claim 1, wherein said intercept latch has a bearing hole which is an elongated hole, said intercept latch is loaded by a spring which strives to rotate said intercept latch against the release direction and to move it away from said trigger latch.

20. A trigger device according to claim 1, further comprising an automatically engaging and disengaging return lock device for the trigger lever.

21. A trigger device according to claim 1, wherein said intercept latch is supported movably longitudinally against spring force in said trigger housing.

* * * * *